United States Patent [19]

Helver

[11] Patent Number: 5,056,578

[45] Date of Patent: Oct. 15, 1991

[54] CARRIER STRUCTURE FOR A VERTICAL BLIND ASSEMBLY

[76] Inventor: Oscar Helver, 13501 SW. 81st St., Miami, Fla. 33183

[21] Appl. No.: 559,134

[22] Filed: Jul. 30, 1990

[51] Int. Cl.[5] ..... E06B 9/26

[52] U.S. Cl. ..... 160/177; 160/900; 74/422; 74/411

[58] Field of Search ..... 160/177, 176.1, 168.1, 160/900; 74/89.17, 422, 411

[56] References Cited

U.S. PATENT DOCUMENTS

| | | | |
|---|---|---|---|
| 3,280,891 | 10/1966 | Eldredge et al. | 160/900 X |
| 4,122,884 | 10/1978 | Salzmann | 160/168.1 |
| 4,559,670 | 12/1985 | Wyatt | 160/177 X |
| 4,628,981 | 12/1986 | Ciraci et al. | 160/176.1 |
| 4,834,163 | 5/1989 | Dickstein | 160/177 X |
| 4,848,434 | 7/1989 | Morris et al. | 160/168.1 |
| 4,848,435 | 7/1989 | Helver | 160/900 X |

*Primary Examiner*—David M. Purol

*Attorney, Agent, or Firm*—James E. Wetterling, Jr.

[57] ABSTRACT

A carrier assembly and support frame of the type used to movably support one of a plurality of vertically oriented slats in a vertical blind assembly and incorporating a plurality of gears which interact with one another and with a splined tilt rod to cause rotation of the supported slat upon rotation of the tilt rod. Two of the gear structures comprise elongated rack gears movable both with one another upon rotation of the tilt rod and relative to one another to define a clutch mechanism if the slat is obstructed from rotation about its own longitudinal access.

13 Claims, 2 Drawing Sheets

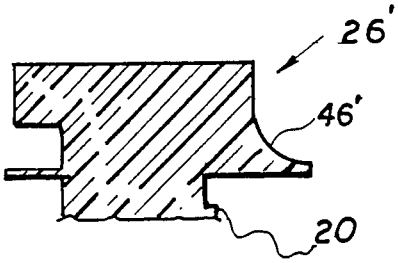
FIG. 8
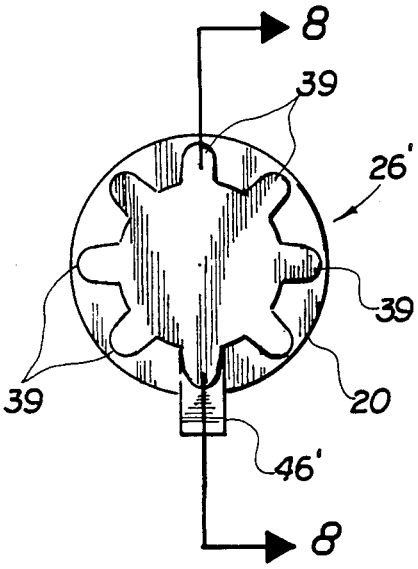
FIG.7
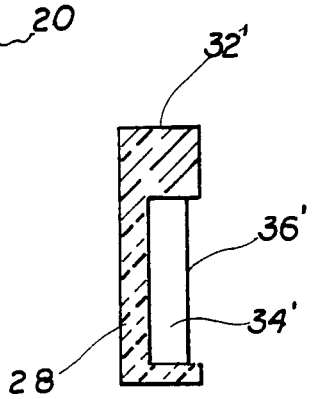
FIG. 5
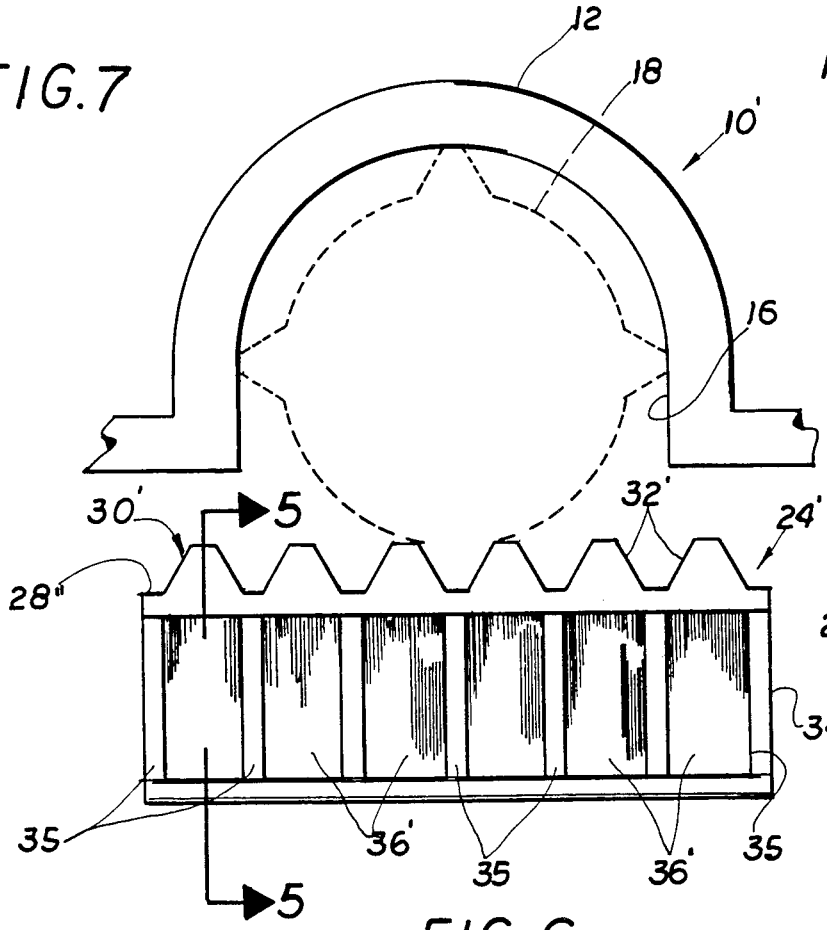
FIG. 6
FIG. 9
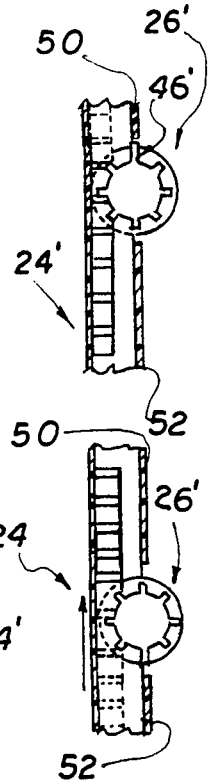
FIG.10

CARRIER STRUCTURE FOR A VERTICAL BLIND ASSEMBLY

BACKGROUND OF THE INVENTION

1. Field of the Invention

A carrier assembly including a support frame for rotatably and movably supporting a vertically oriented slat in a vertical blind assembly and further including a clutch mechanism defined by relatively movable gears drivingly interconnecting the slat to a splined tilt rod for rotation of the slat upon rotation of the tilt rod.

2. Description of the Prior Art

Vertical blind assemblies are of course well known in the prior art and typically include a plurality of vertically oriented blinds each mounted to rotate about their own longitudinal axis as well as travel along a horizontally mounted supporting header structure. Such blind assemblies are used to cover doors, windows or like openings or portals of a building structure to regulate light and other passage therethrough. Well known prior art vertical blind assemblies of the type set forth herein include a plurality of carrier frames each structured to support one of the plurality of slats and vertically depending relation therefrom. Further, the support frames are structured to selectively move along the length of the header structure so as to collectively position the plurality of slats between what may be generally referred to as an open position and a closed position. Further, an elongated splined tilt rod normally extends along the length of the header structure and is disposed in cooperative relation to each of the carrier frames. A gear mechanism typically serves to interconnect the splined tilt rod with the vertically oriented and supported slat such that rotation of the tilt rod in either of two opposite directions will cause rotation of the slats, collectively about their own respective longitudinal axis and also in opposite directions.

One problem generally recognized with prior art vertical blind assemblies is the tendency of one or more of the slats to become jammed and therefore displaced such that intended collective rotation of the slats will result in the one or more slats having a different angular orientation than the remaining properly oriented slats.

The prior art has attempted to overcome the above set forth problems through the inclusion of some type of alignment mechanism and/or clutch assembly which will allow "automatic" reorientation of the displaced slats without requiring individual manual adjustment or realignment. Such readjustment is of course necessary when one or more of the displaced slats become tangled to prevent its longitudinal rotation with the remaining slats of the vertical blind assembly. In addition to the inconvenience of adjusting such individually displaced slats, damage could further be done to the individual support or carrier frames when the user of the assembly tries to rotate or otherwise position the slats collectively in the normal manner.

Accordingly, there is an obvious need in this area for a carrier assembly incorporating a support frame having mounted thereon an adjustment structure preferably in the form of some type of clutch mechanism. Continued rotation of the tilt rod in the normal manner, in an attempt to angularly orient all of the vertically disposed slats, will not result in damage to the components of the support frame or the vertical blind assembly but rather the "automatic" realignment of otherwise displaced vertical slats. Such a preferred structure should be inexpensive, readily adaptable to existing components and/or vertical blind assemblies and capable of long lasting efficient operation for its intended purpose.

SUMMARY OF THE INVENTION

The present invention relates to a carrier assembly of the type used to movably support individual ones of a plurality of vertically oriented slats from a horizontally mounted header in a vertical blind assembly. More specifically, the carrier assembly of the present invention comprises a support frame having an aperture formed therein which in one embodiment may be substantially centrally disposed. This aperture is dimensioned and configured to allow passage therethrough of an elongated splined tilt rod of the type well known in the prior art. A support finger is removably or otherwise attached so as to depend vertically downward from a lower end of the support frame. Further, the support finger is structured to removably engage and support an upper end of one vertical slat such that the slat rotates about its own longitudinal axis upon rotation of the finger. In addition, each of the vertically oriented slats moves along the length of the header structure with the individual support frame to which it is attached so as to collectively move all of the plurality of the slats between an open and close position.

An upper end of the support finger has a drive gear secured thereto. In addition, a gear means is movably mounted on the frame and serves to interconnect the tilt rod with the drive gear of the finger. As a result, rotation of the tilt rod about its own longitudinal axis causes rotation of the support finger and the vertical slat to which it is attached about their respective longitudinal axes in either of two opposite directions.

An important feature of the present invention is the structure of the aforementioned gear means. A first gear has an elongated rack gear type configuration and is integrally or otherwise fixably mounted on an elongated base. A second gear also has an elongated rack type configuration and is mounted on the base of the first gear in a manner which facilitates movement of this first and second gear together longitudinally in opposite directions. Alternately, the first and second gears are movable relative to one another upon continued rotation of the tilt rod when the vertically oriented slat has become jammed and thereby maintained in a fixed position. Such relative movement between the first and second gears occur by a slippage therebetween since such first and second gears are preferably interconnected by a frictional yet sliding engagement. As a result, a clutch mechanism is defined which will eliminate undue force or pressure on the support finger and attached slat which has become jammed and upon further continued rotation of the tilt rod.

Other features associated with the present invention is the existence of stop means in the form of a stop structure mounted on the drive gear of the support finger and disposed in interruptive relation to the second gear so as to limit rotation of the support finger and the vertical slat attached thereto through a predetermined arc of preferably but not necessarily substantially 180 degrees.

BRIEF DESCRIPTION OF THE DRAWINGS

For a fuller understanding of the nature of the present invention, reference should be had to the following detailed description taken in connection with the accompanying drawings in which:

FIG. 5 is a sectional view along line 5—5 of FIG. 6.

FIG. 6 is a front view and partial phantom of a another embodiment of the present invention.

FIG. 7 is a top view of a component of the other embodiment of the present invention.

FIG. 8 is a sectional view along line 8—8 of FIG. 7.

FIG. 9 is a top view and partial section showing the interaction of components of this embodiment.

FIG. 10 is a transverse sectional view showing interaction of working components of the present invention.

Like reference numerals refer to like parts throughout the several views of the drawings.

DETAILED DESCRIPTION OF THE PREFERRED EMBODIMENT

Figure 1:
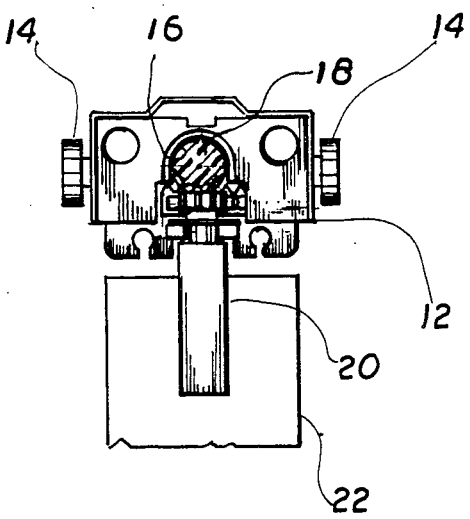
FIG. 1 is a front view of an assembled carrier assembly of the present invention.
Figure 2:
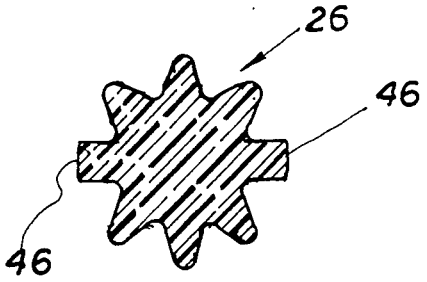
FIG. 2 is a sectional view of a drive gear of a gear mechanism associated with the carrier assembly of the present invention.

As shown primarily in FIGS. 1 and 2, the carrier assembly of the present invention is generally indicated as 10 and comprises a support frame 12 having a substantially one piece construction. Opposite ends of the support frame incorporate rollers as at 14 to facilitate travel of the frame along the length of a conventional horizontally disposed header structure (not shown for purposes of clarity). The frame 12 has an aperture as at 16 centrally disposed therein and dimensioned so as to allow passage therethrough of a splined tilt rod 18 of the type well known in the vertical blind industry. As is also well known, rotation of the tilt rod 18 about its own longitudinal axis will serve to rotate a depending support finger 20 as well as a slat 22 having its upper end attached to the support finger 20.

Figure 3:
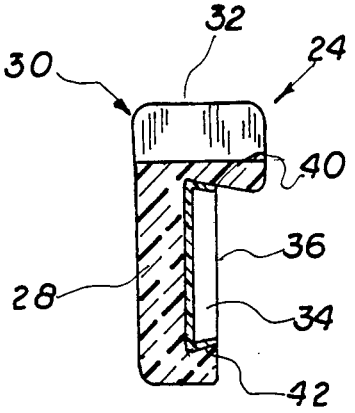
FIG. 3 is a sectional view taken along 3—3 of FIG. 4.
Figure 4:
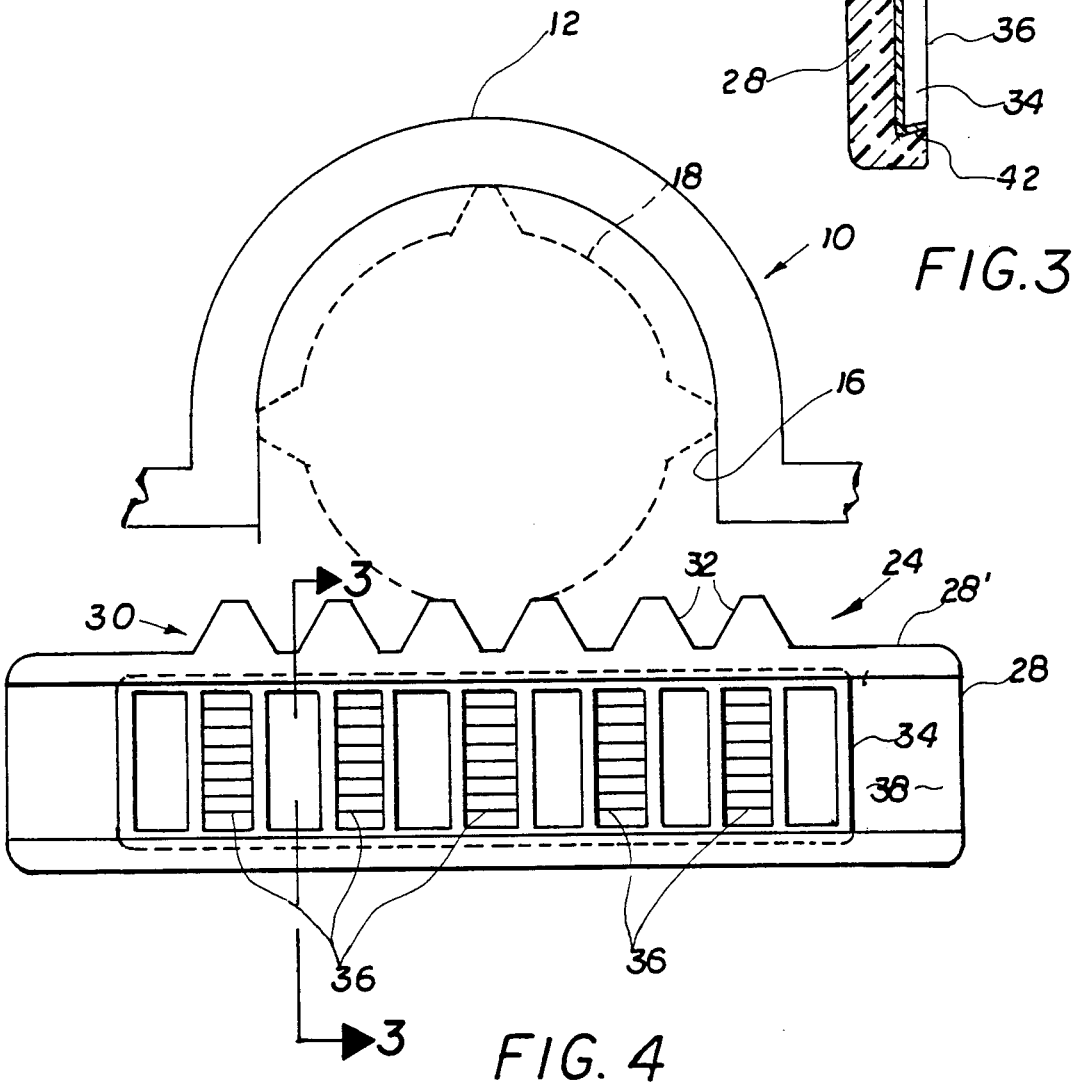
FIG. 4 is a front view of a gear assembly and associated components of the present invention.

An important feature of the present invention is the provision of a gear means generally indicated as 24 and comprising, in part, a drive gear 26 mounted on and rotatable with the support finger 20. The drive gear 26 is attached to one end thereof so as to be mounted in meshing engagement with the gear means 24 in the manner to be described in greater detail hereinafter. The gear means 24 includes a one piece base 28 having an elongated configuration and having a first gear generally indicated as 30 attached thereto along at least a major portion of the length thereof as shown in FIG. 4. The first gear 30 has a plurality of gear teeth 32 disposed in spaced apart relation to one another and extending outwardly from one longitudinal edge 28′ of the base 28 into meshing engagement with the splines on the external surface of the splined tilt rod 18. In addition, the gear means 24 includes a second gear 34 also having an elongated configuration with a plurality of gear teeth 36 extending outwardly as shown in FIGS. 3 and 4. As further shown, the base 28 includes an elongated channel 38 integrally formed therein and extending along the length thereof. The channel 38 and the second gear 34 have cooperating transverse configurations so as to mount the second gear 34 within the channel 38. As shown in FIG. 3, a frictional engagement exists between the exterior surface of certain portions of the second gear 34 and the interior surface of certain portions of the channel means 38. Contact points appear substantially at 40 and 42. It should be emphasized that these contact points may in fact vary, however, depending upon the preferred respective transverse configurations of the channel 38 and the second gear 34. The relative dimensions between the channel 38 and the second gear 34 are such as to define an extremely tight fit but establish a coefficient friction which will allow certain relative sliding movement between the second gear 34 and the base 28 and of course first gear 30 mounted thereon. As further shown in FIG. 3, the cooperative transverse configurations define somewhat of a "dovetail" configuration.

It should be apparent from the above set forth description, that under normal circumstances the second gear 34 will move with the first gear 30 due to its frictional engagement within the channel 38. In addition, rotation of the tilt rod 18 will cause longitudinal travel of the first and second gears 30 and 34 and of course the base 28 in either of two opposite directions depending upon the direction of rotation of the tilt rod.

The second gear 11 is disposed in mating, driving engagement with the drive gear 26 mounted on and movable with the elongated support finger 20. The gear means 24 therefore serves to drivingly interconnect the support finger 20 as well as the slat 22 attached thereto to the tilt rod. Rotation of the tilt rod will result therefore in rotation of the support finger 20 and the slat 22 about their respective longitudinal axis.

A common problem associated with the vertical blind industry is the tendency of the blinds to become obstructed or "jammed" thereby maintaining the slats and/or the supporting finger 22 and 20, respectively, in somewhat of a fixed position. This will of course have a tendency to fix the position of the second gear 34. Upon continued or forced rotation of the tilt rod, in an attempt to rotate all of the slats of the vertical blind assembly into a common angular orientation, a sliding movement will occur between the base 28 and first gear 30 as they travel with the rotation of the tilt rod and the second gear 34 as it is maintained in a fixed position due to its engagement with the drive gear 26. Again this will occur when the particular slat 22, finger 20 and drive gear 26 are obstructed and are not able to rotate with the remaining slats of the vertical blind assembly. The result is a defined clutch mechanism which will prevent damage to the carrier assembly 10 as well as the slat attached thereto when such obstruction or jamming occurs of any one or plurality of slats.

Another feature of the present invention is shown in FIG. 2 wherein a stop means is provided in the form of two outwardly extending projections 46 integrally formed on the drive gear 26 in spaced relation to one another. Upon rotation of the drive gear, one of the projections 46, depending upon the direction of rotation of the drive gear 26, will engage the teeth 36 of the second gear 34 causing a stopping of relative rotation therebetween. Preferably, the outer projections 46 of the stop means as demonstrated in FIG. 2 will be spaced apart approximately 180 degrees, therefore, limiting the arc of rotation of the drive gear to the same 180 gears. This stop means therefore facilitates "automatic" alignment when one of the slats associated with a particular support finger 20 becomes misaligned. The operator merely rotates all of the slats to their farthest extent in one direction and then reverses and rotates all of the slats to their farthest rotation in the opposite direction. Existence of a stop means and in cooperation with the clutch mechanism as defined by the first and second gears 30 and 34 will serve to automatically realign the disoriented slat or slats.

Yet another embodiment of the present invention is shown in FIGS. 5 through 10 wherein the carrier assembly of the present invention as generally indicated as 10' and comprises a support frame 12 having a substantially one piece construction. The frame 12 has an aperture as at 16 centrally disposed therein to allow passage therethrough of a multi-splined tilt rod 18. Rotation of the tilt rod about its own longitudinal axis will serve to rotate the depending support finger 20 and the slat 22 having its upper end attached thereto.

In this embodiment a gear means is generally indicated as 24' and comprises, in part, a drive gear 26' mounted on and rotatable with an upper end of the support finger 20. The drive gear 26' is attached to one end thereof so as to be mounted in meshing engagement with the gear means 24' in the manner to be described hereinafter. The gear means 24' includes a one piece base 28 having an elongated configuration and further including a first gear generally indicated as 30' attached thereto along at least a major portion of the length, as best shown in FIG. 6. The first gear 30' has a plurality of gear teeth 32' disposed in spaced apart relation to one another and extending outwardly from one longitudinal edge 28'' of the base 28 and into meshing engagement with the splines on the external surface of the tilt rod 18, as best shown in FIG. 6. In addition, the gear means 24' includes a second gear 34' also having an elongated configuration and including a plurality of gear teeth 35 separated by a plurality of pockets 36'. In the embodiment of FIGS. 5 through 10, the gear teeth 35 and in the pockets 36' are integrally and fixedly formed on the exposed face of the base 28'' and are disposed in meshing engagement with the outwardly extending teeth 39 formed on the drive gear 26'.

It should be apparent therefor the rotation of the splined tilt rod 18, due to its engagement with the first gear 30' and the teeth thereof, will cause longitudinal movement of the second gear 34'. The teeth 35 and pockets 36' meshing with the teeth 39 on the drive gear 26' will cause rotation of the finger 20 about its own longitudinal axis as well as the slat 22 attached thereto.

Another feature of this embodiment includes a stop means having a single outwardly extending finger 46' (see FIGS. 7, 8, 9 and 10). The outwardly extending projection or finger 46' is fixedly attached to the upper end of the finger 20 adjacent to the gear means 26'. Rotation of the support finger 20 will cause the stop means 46', once it rotates through an arc of 180 degrees, to come into contact with two stop members 50 and 52. This will limit the axial rotation of the slat 20 to an arc of rotation, also of 180 degrees.

As set forth above, a common problem associated with the vertical blind industry is the tendency of the blinds to become obstructed or jammed. In this embodiment, continued or forced rotation of the tilt rod 18 in an attempt to rotate all of the slats in the vertical blind assembly into a common angular orientation will result in a "jumping" of the gear means 24' relative to is engagement with the drive gear 26' and more specifically the teeth 39 extending outwardly therefrom. Such "jumping" movement will occur, as represented in phantom lines in FIG. 10, so as to properly align the gear means 24' and the drive gear 26' when the outwardly extending projection 46' of the stop means engages the stop members 50 and/or 52 associated with the carrier frame 12.

Now that the invention has been described, what is claimed is:

1. A carrier assembly for movably supporting one of a plurality of vertically oriented slats in a vertial blind assembly, said carrier comprising:

(a) a frame having an opening formed therein and disposed and dimensioned to rotatabily receive a splined tilt rod therein in substantially transverse relation to the frame, (b) a support finger movably mounted to rotate on said frame about its own longitudinal access and being removably and supportingly attached to an upper end of the one slat, (c) a gear means drivingly interconnecting the tilt rod to the support finger for rotation of the support finger and the slat attached thereto upon rotation of the tilt rod, (d) said gear means comprising a drive gear formed on said support finger and further comprising a first gear connected in driven engagement to the tilt rod and a second gear connected in driving engagement to said drive gear and said support finger and movable with said first gear upon rotation of the tilt rod, and (e) said first and second gears each having an elongated linear configuration and said first gear mounted to move linearly with and relative to said second gear and movable with continued rotation of the tilt rod upon fixed positioning of said second gear and said support finger and slat supported thereon.

2. An assembly as in claim 1 wherein said first gear is an elongated rack gear including a plurality of outwardly extending gear teeth disposed in meshing engagement with the splined tilt rod.

3. An assembly as in claim 1 wherein said first gear is movable longitudinally along its length in opposite directions and transversely to the length of the tilt rod upon rotation of the tilt rod in opposite directions.

4. An assembly as in claim 3 wherein said second gear comprises an elongated rack gear structured for mating, driving engagement with said drive gear of said support finger, said second gear movable along its length in opposite directions and in a substantially parallel path of travel as said first gear.

5. A carrier assembly for movably supporting one of a plurality of vertically oriented slats in a vertical blind assembly, said carrier assembly comprising:

(a) a frame having an opening formed therein and disposed and dimensioned to rotatably receive a splined tilt rod therein in substantially transverse relation to the frame, (b) a support finger movably mounted to rotate on said frame about its own longitudinal access and being removably and supportingly attached to an upper end of the one slat, (c) a gear means drivingly interconnecting the tilt rod to the support finger for rotation of the support finger and the slat attached thereto upon rotation of the tilt rod, (d) said gear means comprising a drive gear formed on said support finger and further comprising a first gear connected in driven engagement to the tilt rod and a second gear connected in driving engagement to said drive gear and said support finger and movable with said first gear upon rotation of the tilt rod, (e) said gear means comprising an elongated base and said first gear formed thereon in the form of a rack gear disposed in meshing, driven engagement with the splined tilt rod, (f) said second gear comprising an elongated rack gear movable with said base and said first gear relative to said base reciprocally along its own length in opposite directions, (g) said base comprising an elongated channel formed therein along the length thereof, said second gear mounted within said channel in frictional, sliding engagement with the exposed surfaces of said channel, and (h) said first gear mounted to move with and relative to said second gear and movable with continued rotation of the tilt rod upon fixed positioning of said second gear and said support finger and slat supported thereon.

6. An assembly as in claim 5 wherein said channel comprises an open longitudinal face of sufficient dimension to expose and matingly engage a plurality of gear teeth on said second gear with a gear formed on said support finger.

7. An assembly as in claim 5 wherein said channel and said second gear comprise cooperatively configured cross-sectional configurations to define said frictional, sliding engagement therebetween.

8. An assembly as in claim 7 wherein said cooperative cross-sectional configuration defines a mating dovetail engagement.

9. An assembly as in claim 5 wherein said channel and said second gear are dimensioned, configured and structured to define a co-efficient of friction therebetween sufficient to allow relative movement between said first and second gears upon fixed positioning of said support finger and first gear and a continued predetermined force applied to the tilt rod and second gear.

10. An assembly as in claim 5 further comprising stop means formed on said support finger and disposed to engage a remainder of said gear means and restrict rotation of said support finger through a predetermined arc.

11. An assembly as in claim 10 wherein said stop means comprises two outwardly extending protrusions disposed in spaced relation to one another on said drive gear in an interruptive engagement with said first gear.

12. An assembly as in claim 11 wherein said predetermined arc is substantially 180 degrees.

13. A carrier assembly for movably supporting one of a plurality of vertical oriented slats in a vertical blind assembly, said carrier assembly comprising:

(a) a frame having an opening formed therein and disposed and dimensioned to rotatably receive a splined tilt rod therein in substantially transverse relation to the frame, (b) a support finger movably mounted to rotate on said frame about its own longitudinal axis and being removably and supportingly attached to an upper end of one slat, (c) a gear means drivingly interconnecting the tilt rot to the support finger for rotation of the support finger and the slat attached thereto upon rotation of the tilt rod, (d) said gear means comprising a drive gear formed on said support finger and further comprising a first gear connected in driven engagement to the tilt rod and a second gear connected in driving engagement to said drive gear and said support finger and movable with said first gear upon rotation of the tilt rod, (e) said first gear and said second gear fixedly connected to one another and movable with one another upon rotation of the tilt rod, (f) said first and second gears forced into continued longitudinal movement relative to a fixed positioning of said drive gear relative to said frame and a continuing forced rotation of said tilt rod, (g) stop means formed on a rotatable with said support finger and extending outwardly therefrom into engaging relation with one of two spaced apart stop members formed on said frame, (h) said stop means comprising one outwardly extending protrusion disposed to engage each of said stop members on said frame upon rotation through an arc of substantially 180 degrees, and (i) said drive gear including a substantially round configuration and a plurality of gear teeth formed thereon in spaced relation to one another along an outer periphery of said drive gear to define a circular configuration thereof; said second gear comprising a plurality of gear teeth linearly arranged in spaced relation along the length of said base; said gear teeth of said second gear forced into successive engagement and displacement relative to said gear teeth of said drive gear upon said continued longitudinal movement of said base and said first and second gears relative to said fixed positioning of said drive gear.

* * * * *

UNITED STATES PATENT AND TRADEMARK OFFICE

CERTIFICATE OF CORRECTION

PATENT NO. : 5,056,578
DATED : October 15, 1991
INVENTOR(S) : Oscar Helver

It is certified that error appears in the above-identified patent and that said Letters Patent is hereby corrected as shown below:

Column 8,
Line 30, change the word "a" to the word -- and --.

Signed and Sealed this

Third Day of February, 2004

JON W. DUDAS
*Acting Director of the United States Patent and Trademark Office*

US005056578C1

(12) REEXAMINATION CERTIFICATE (4241st)

United States Patent

Helver

(10) Number: US 5,056,578 C1

(45) Certificate Issued: Jan. 2, 2001

(54) CARRIER STRUCTURE FOR A VERTICAL BLIND ASSEMBLY

(75) Inventor: Oscar Helver, Miami, FL (US)

(73) Assignee: Novo Industries, L.P., Houston, TX (US)

Reexamination Request:
No. 90/005,551, Nov. 8, 1999

Reexamination Certificate for:

| | |
|---|---|
| Patent No.: | **5,056,578** |
| Issued: | **Oct. 15, 1991** |
| Appl. No.: | **07/559,134** |
| Filed: | **Jul. 30, 1990** |

(51) Int. Cl.[7] ..... E06B 9/26

(52) U.S. Cl. ..... 160/177; 160/900; 74/422; 74/411

(58) Field of Search ..... 160/177, 176.1, 160/168.1, 900; 74/89.17, 422, 411

(56) References Cited

U.S. PATENT DOCUMENTS

| | | |
|---|---|---|
| 2,996,115 | 8/1961 | Klenz . |
| 4,267,875 | 5/1981 | Koks . |
| 4,335,775 | 6/1982 | Frentzel . |
| 4,350,197 | 9/1982 | Haller . |
| 4,381,811 | 5/1983 | Frentzel . |
| 4,552,195 | 11/1985 | Durig . |
| 4,616,688 | 10/1986 | Agos . |
| 4,628,981 | 12/1986 | Ciriaci . |
| 4,648,436 | 3/1987 | Oskam . |
| 4,834,163 | 5/1989 | Dickstein . |
| 4,928,744 | 5/1990 | Oskam . |

FOREIGN PATENT DOCUMENTS

| | | |
|---|---|---|
| 1589830 | 10/1976 | (DK) . |
| 0063265 | 10/1982 | (EP) . |
| 0120567 | 10/1984 | (EP) . |
| 1500438 | 2/1978 | (GB) . |
| 2031493 | 4/1980 | (GB) . |
| 2036144 | 6/1980 | (GB) . |
| 2104949 | 3/1983 | (GB) . |

*Primary Examiner*—David Purol

(57) ABSTRACT

A carrier assembly and support frame of the type used to movably support one of a plurality of vertically oriented slats in a vertical blind assembly and incorporating a plurality of gears which interact with one another and with a splined tilt rod to cause rotation of the supported slat upon rotation of the tilt rod. Two of the gear structures comprise elongated rack gears movable both with one another upon rotation of the tilt rod and relative to one another to define a clutch mechanism if the slat is obstructed from rotation about its own longitudinal access.

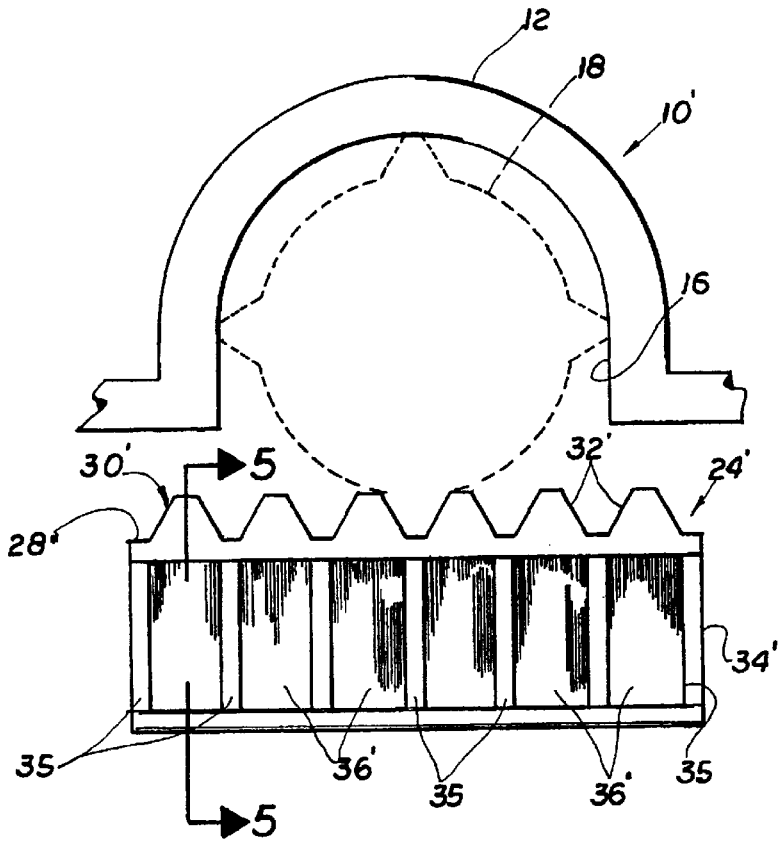

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–13 is confirmed.

* * * * *